US011254147B2

(12) United States Patent
Yoshida

(10) Patent No.: US 11,254,147 B2
(45) Date of Patent: Feb. 22, 2022

(54) MEDIUM TRANSPORT DEVICE AND RECORDING APPARATUS

(71) Applicant: SEIKO EPSON CORPORATION, Tokyo (JP)

(72) Inventor: Kazuki Yoshida, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 19 days.

(21) Appl. No.: 16/773,193

(22) Filed: Jan. 27, 2020

(65) Prior Publication Data

US 2020/0238736 A1 Jul. 30, 2020

(30) Foreign Application Priority Data

Jan. 30, 2019 (JP) ..... JP2019-014059

(51) Int. Cl.
*B41J 13/00* (2006.01)

(52) U.S. Cl.
CPC ..... *B41J 13/0009* (2013.01)

(58) Field of Classification Search
CPC ..... B41J 13/0009; B41J 11/0095; B65H 2553/414; B65H 2553/412; B65H 29/52; B65H 29/125; B65H 29/14; B65H 2404/611; B65H 2601/2611; B65H 43/08; B65H 2801/15; B65H 2701/1311; B65H 2701/1313
See application file for complete search history.

(56) References Cited

U.S. PATENT DOCUMENTS

2018/0118488 A1 5/2018 Suzuki et al.

FOREIGN PATENT DOCUMENTS

JP 2000-289888 10/2000
JP 2018-076174 5/2018

*Primary Examiner* — Kristal Feggins
(74) *Attorney, Agent, or Firm* — Workman Nydegger

(57) ABSTRACT

A medium transport device includes a medium transport path for transporting a medium, and a medium detection unit that detects a medium by using detection light intersecting the medium transport path. the medium detection unit is a part constituting an optical path of the detection light, and includes a first optical component positioned on a first side of the medium transport path, and a second optical component positioned on a second side with the medium transport path interposed therebetween, and the second optical component is accommodated in a recess formed in a wall face extending in a direction intersecting a path surface of the medium transport path.

4 Claims, 11 Drawing Sheets

MEDIUM TRANSPORT DEVICE AND RECORDING APPARATUS

The present application is based on, and claims priority from JP Application Serial Number 2019-014059, filed Jan. 30, 2019, the disclosure of which is hereby incorporated by reference herein in its entirety.

BACKGROUND

1. Technical Field

The present disclosure relates to a medium transport device that transports a medium, and a recording apparatus including the same.

2. Related Art

In recording apparatuses such as facsimile machines and printers, a detection unit is provided in a paper sheet transport path to detect passage of the leading end or trailing end of a paper sheet, which is an example of a medium. Such a detection unit includes, for example, an optical sensor composed of a pair of a light emitting element that emits detection light toward the paper sheet transport path, and a light receiving element that receives light emitted by the light emitting element. JP-A-2018-76174 is an example of the related art.

When a paper sheet is transported in the paper sheet transport path, paper dust may be generated from the paper sheet. Further, in addition to paper dust, ink mist and dust may be scattered in the paper sheet transport path. These foreign matters may be attached to the light emitting element or the light receiving element, leading to a decrease in detection performance.

SUMMARY

According to an aspect of the present disclosure, a medium transport device includes a medium transport path that transports a medium, and a medium detection unit that detects a medium by using detection light intersecting the medium transport path, wherein the medium detection unit is a part constituting an optical path of the detection light, and includes a first optical component positioned on a first side of the medium transport path, and a second optical component positioned on a second side with the medium transport path interposed therebetween, and the second optical component is accommodated in a recess formed in a wall face extending in a direction intersecting a path surface of the medium transport path.

DESCRIPTION OF EXEMPLARY EMBODIMENTS

Figure 1:
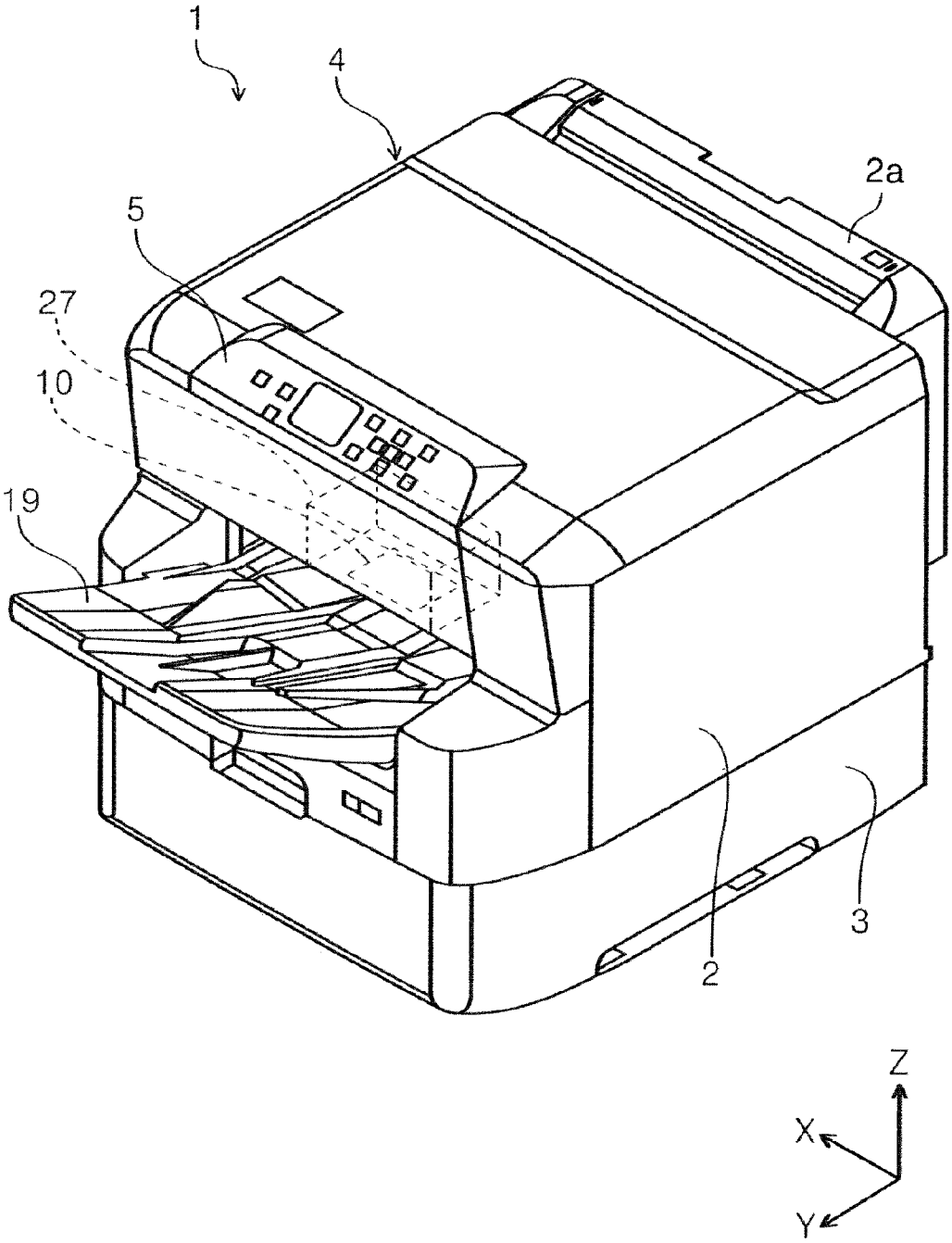
FIG. 1 is a perspective view of an appearance of a printer.

The present disclosure will be schematically described. According to a first aspect of the disclosure, a medium transport device includes: a medium transport path that transports a medium; and a medium detection unit that detects a medium by using detection light intersecting the medium transport path, wherein the medium detection unit is a part constituting an optical path of the detection light, and includes a first optical component positioned on a first side of the medium transport path, and a second optical component positioned on a second side with the medium transport path interposed therebetween, and one or both of the first optical component and the second optical component are accommodated in a recess formed in a wall face that extends in a direction intersecting a path surface of the medium transport path.

With this configuration, since one or both of the first optical component and the second optical component are accommodated in a recess formed in a wall face extending in a direction intersecting a path surface of the medium transport path, one or both of the first optical component and the second optical component are hidden from the medium transport path to thereby reduce attachment of foreign matters to one or both of the first optical component and the second optical component. In addition, the optical component described herein includes all the components that can constitute the optical path of detection light, such as a light emitting element, light receiving element, lens, prism, reflecting plate, and transparent plate. The first optical component and the second optical component may be any of these components.

According to a second aspect in the above first aspect, the medium transport path may extend in a direction intersecting a vertical direction, and the second optical component may be positioned under the medium transport path and accommodated in the recess. With this configuration, the medium transport path extends in a direction intersecting a vertical direction, and the second optical component is positioned under the medium transport path and accommodated in the recess. Accordingly, although foreign matters are likely to fall and attached to the second optical component due to the action of the gravitational force, attachment of foreign matters to the second optical component can be reduced by virtue of the advantageous effect of the first aspect described above since the second optical component is accommodated in the recess.

According to a third aspect in the above second aspect, the medium transport device may further include a protrusion that protrudes from the wall face between the recess and the medium transport path. With this configuration, since a protrusion that protrudes from the wall face is provided between the recess and the medium transport path, the protrusion can reduce the amount of foreign matters flowing from the medium transport path toward the second optical component.

According to a fourth aspect in the above second or third aspect, the wall face may extend downward from the recess. With this configuration, since the wall face extends downward from the recess, it is possible to prevent foreign matters from accumulating at an end of the wall face and entering the recess.

According to a fifth aspect in any one of the above second to fourth aspects, the recess may be covered with a transparent member that transmits the detection light. With this configuration, since the recess is covered with the transparent member that transmits the detection light, entry of foreign matters into the recess can be effectively reduced.

According to a sixth aspect in any one of the above second to fifth aspects, the wall face may be a surface extending along a medium transport. With this configuration, in which the wall face is a surface extending along a medium transport direction, the advantageous effect of the above aspect can be achieved.

According to a seventh aspect in any one of the above second to fifth aspects, the wall face may be a surface oriented downstream in the medium transport direction. With this configuration, in which the wall face is a surface oriented downstream in the medium transport direction, the advantageous effect of the above aspect can be achieved.

According to an eighth aspect in any one of the above second to fifth aspects, the wall face may be a surface oriented upstream in the medium transport direction. With this configuration, in which the wall face is a surface oriented upstream in the medium transport direction, the advantageous effect of the above aspect can be achieved.

According to a ninth aspect in any one of the above second to eighth aspects, the medium transport device may further include a facing surface that faces the wall face and extends in a direction intersecting a path surface of the medium transport path, wherein the first optical component may include a light emitting element that emits the detection light, the second optical component may include a first reflecting surface that reflects the detection light, and the facing surface may be provided with a second reflecting surface that reflects the detection light emitted by the first optical component toward the second optical component, and reflects the detection light reflected by the second optical component toward the first optical component.

With this configuration, since the second reflecting surface is interposed between the first optical component and the second optical component, the optical path of the detection light between the first optical component and the second optical component in increased. Accordingly, since the recess, that is, the second optical component is further away from the medium transport path, it is possible to further reduce attachment of foreign matters to the second optical component.

According to a tenth aspect in the above ninth aspect, the medium transport device may further include a flange that protrudes from the facing surface between the second reflecting surface and the medium transport path. With this configuration, since a flange that protrudes from the facing surface is provided between the second reflecting surface and the medium transport path, it is possible to reduce the amount of foreign matters flowing from the medium transport path toward the second reflecting surface.

According to an eleventh aspect in any one the above second to eighth aspects, the first optical component may include a light emitting element that emits the detection light and a light receiving element that receives the detection light, the second optical component may include a reflecting surface that reflects the detection light toward the first optical component, and the first optical component and the second optical component may be positioned to face each other. With this configuration, in which the first optical component includes a light emitting element that emits the detection light and a light receiving element that receives the detection light, the second optical component includes a reflecting surface that reflects the detection light toward the first optical component, and the first optical component and the second optical component are positioned to face each other, the advantageous effect of the above aspect can be achieved.

According to a twelfth aspect in any one the above second to eighth aspects, the first optical component may include a light emitting element that emits the detection light, the second optical component may include a light receiving element that receives the detection light, and the first optical component and the second optical component may be positioned to face each other. With this configuration, in which the first optical component includes a light emitting element that emits the detection light, the second optical component includes a light receiving element that receives the detection light, and the first optical component and the second optical component are positioned to face each other, the advantageous effect of the above aspect can be achieved.

According to a thirteenth aspect of the disclosure, a recording apparatus includes a recording unit that performs recording on a medium; and the medium transport device according to the above aspect. With this configuration, in the recording apparatus including a recording section that performs recording on a medium, the advantageous effect which is the same as that of the first aspect can be achieved.

The present disclosure will now be specifically described. In the following description, an ink jet printer 1 will be described as an example of the recording apparatus. Hereinafter, the ink jet printer 1 will be simply referred to as a printer 1. In the X-Y-Z coordinate system indicated throughout the drawings, the X axis direction is a scan direction of a recording head 10. The X axis direction is also a width direction of a recording paper on which recording is performed, and is also a width direction of the apparatus. When viewed facing the printer 1, the +X direction is the left direction, whereas the −X direction is the right direction. The Y axis direction is a depth direction of the apparatus, and is also a direction extending substantially along a transport direction of a paper sheet during recording. The +Y direction is a direction directed from the back side to the front side of the apparatus, whereas the −Y direction is a direction directed from the front side to the back side of the apparatus. In the present embodiment, among the side surfaces constituting the printer 1, the side surface on which an discharge tray 19 is provided is the front surface of the apparatus. The Z axis direction is a direction extending along the vertical direction, and is also a height direction of the apparatus. The +Z direction is a vertically upward direction, whereas the −Z direction is a vertically downward direction.

In the following description, an overall configuration of the printer 1 will now be described with reference to FIGS. 1 to 3. The printer 1 shown in FIG. 1 includes a recording unit 2 and a liquid storage unit 3. The recording unit 2 includes various components therein, which include a recording head 10 that performs recording on a recording paper, which is an example of a medium, and a paper sheet transport device 9 (FIG. 2) having a transport path for transporting a recording paper. In the sense that the printer 1 transports a recording paper, it can also be generally regarded as a transport device that transports a recording paper.

Figure 3:
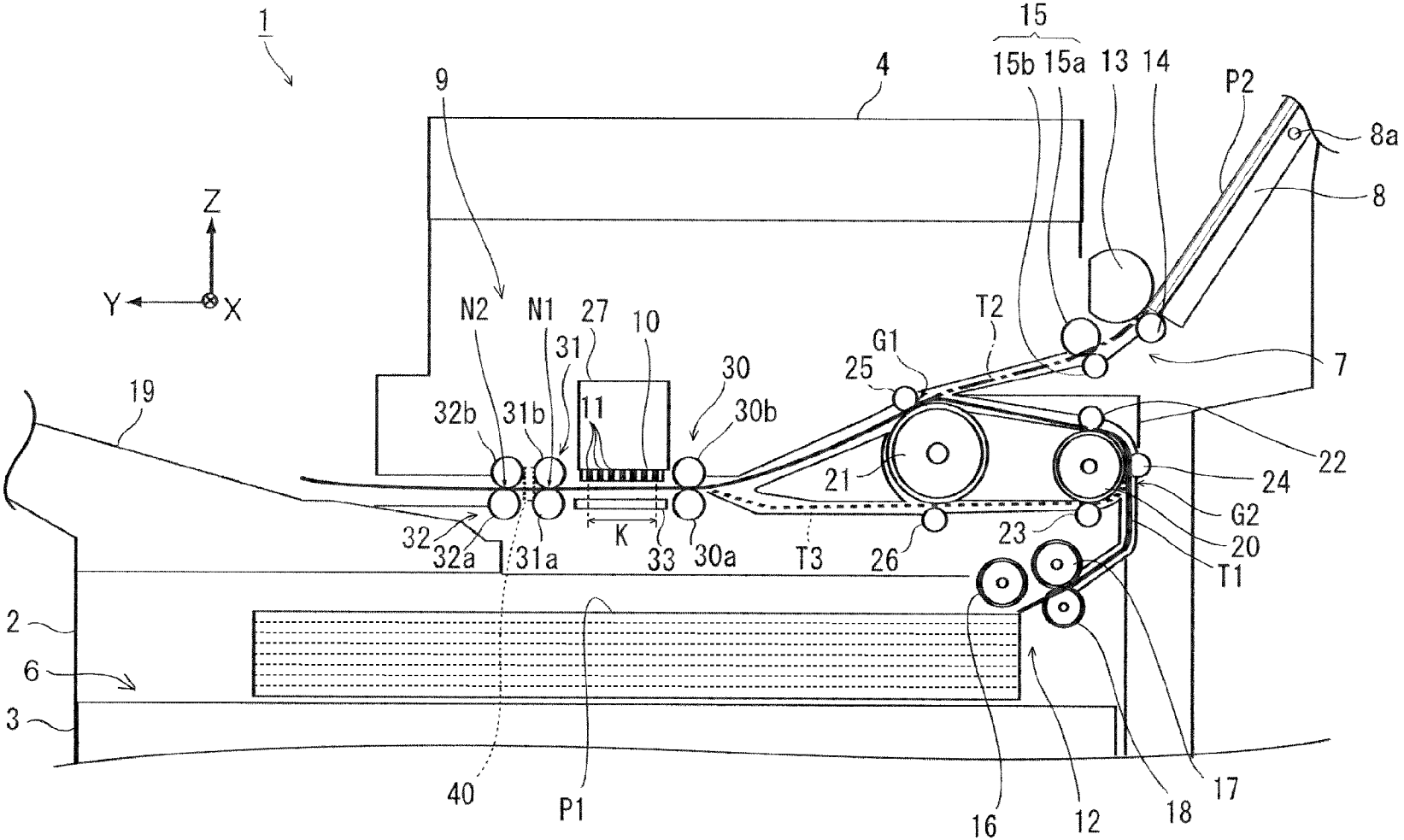
FIG. 3 is a schematic view of a paper sheet transport path of a printer.

As shown in FIG. 3, a plurality of ink ejection nozzles 11 are disposed in the recording head 10. The recording head 10 is mounted on a carriage 27 that is movable in the X axis direction, and is configured as an ink jet recording head that performs recording onto a recording paper by ejecting ink, which is an example of liquid, via the ink ejection nozzles 11 while moving in the X axis direction.

The printer 1 is configured as a multifunction printer having not only a recording function, but also a document recording function, that is, a scanner. In the present embodiment, a scanner unit 4 is disposed in an upper part of the recording unit 2. In FIGS. 1 to 3, the detailed configuration of the scanner unit 4 is not illustrated. As shown in FIG. 1, an operation unit 5 for operating the printer 1 including the scanner unit 4 is disposed in an upper front part of the apparatus.

The liquid storage unit 3 shown in FIG. 1 accommodates a liquid container, which is not shown, that stores ink to be supplied to the recording head 10. Ink is supplied from the liquid container accommodated in the liquid storage unit 3 to the recording head 10 via a tube, which is not shown.

Figure 2:
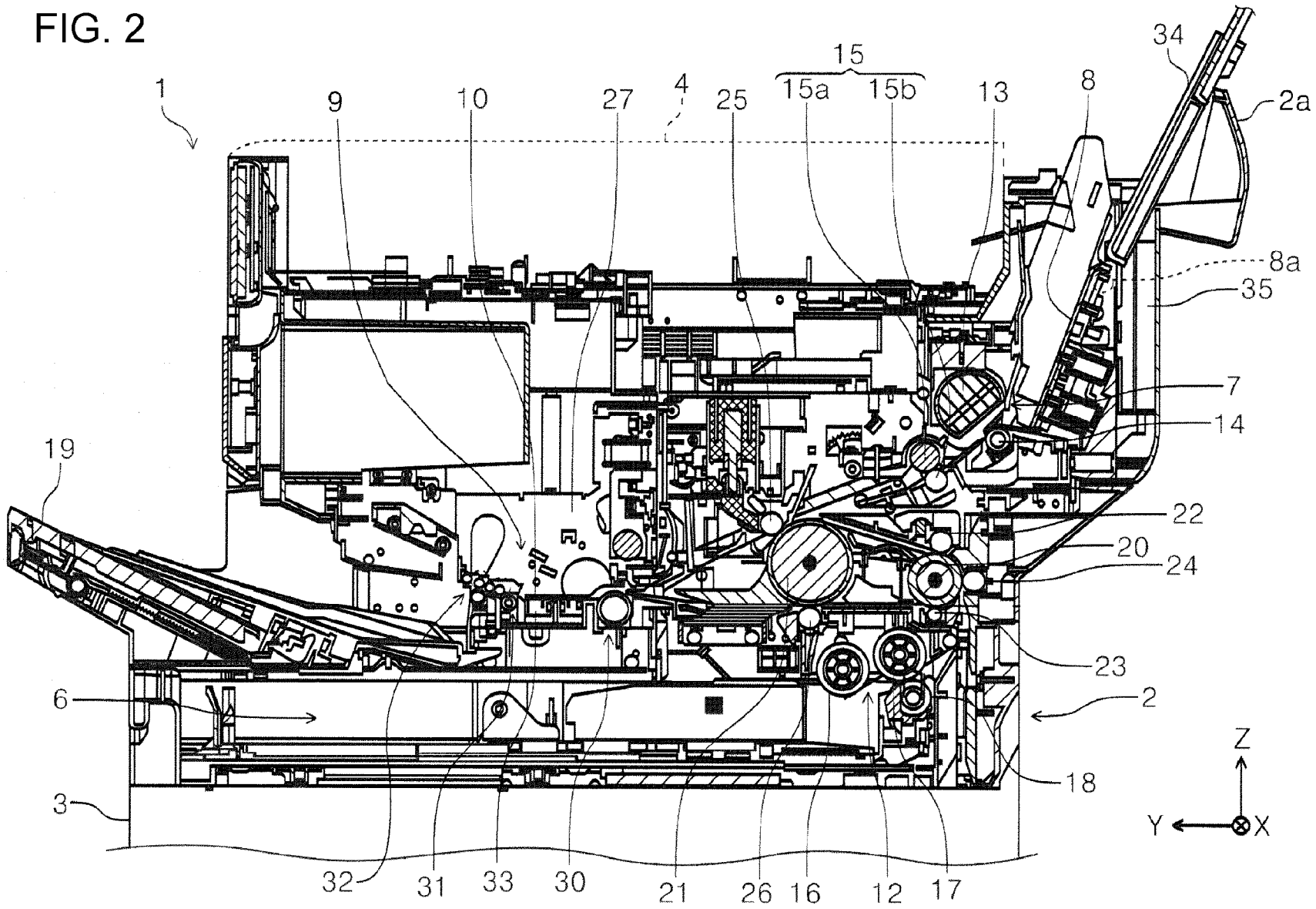
FIG. 2 is a side cross-sectional view of a printer.

The recording unit 2 includes an upper supply mechanism 7 that supplies a recording paper toward the recording head 10 shown in FIG. 2. An upper cover 2*a* is provided in an upper rear part of the apparatus so as to openably close a paper sheet setting unit 8 that is used for setting a recording paper in the upper supply mechanism 7 shown in FIG. 2. When the upper cover 2*a* is opened as shown in FIG. 2, a recording paper can be set in the paper sheet setting unit 8.

Further, as shown in FIG. 2, a paper sheet tray 6 is disposed in the lower part of the recording unit 2. A lower supply mechanism 12 is provided to supply a recording paper from the paper sheet tray 6 toward the recording head 10. The recording head 10 performs recording onto a recording paper supplied by the upper supply mechanism 7 or the lower supply mechanism 12. In addition to the paper sheet tray 6 built in the recording unit 2, the printer 1 may also include an additional paper sheet accommodating unit (not shown) in the lower part of the recording unit 2 or in the lower part of the liquid storage unit 3.

Next, with reference to FIG. 3, a paper sheet transport path of the paper sheet transport device 9 for transporting a recording paper in the printer 1 will be described. In FIG. 3, the solid line denoted by reference numeral T1 indicates the transport path of a recording paper fed from the paper sheet tray 6 by the lower supply mechanism 12. Hereinafter, the path is referred to as a paper sheet transport path T1. Further, the dot and dashed line denoted by reference numeral T2 indicates the transport path of a recording paper fed by the upper supply mechanism 7. The path is referred to as a paper sheet transport path T2.

Further, the printer 1 is configured to perform double-sided recording by performing printing on a first surface of a recording paper and then reversing the recording paper to perform recording on a second surface, which is a surface opposite to the first surface. The dotted line denoted by the reference numeral T3 in FIG. 3 indicates a switchback path T3 through which the recording paper passes when the recording paper is reversed after recording is performed on the first surface in double-sided recording.

In the paper sheet transport device 9, a detection unit 40 is provided to detect passage of a leading end and a trailing end of a recording paper in the paper sheet transport path. The detail of the detection unit 40, which is a feature of the present disclosure, will be described after the description of the paper sheet transport path. The description will be made in the order of the paper sheet transport path T1, the paper sheet transport path T2, and the switchback path T3.

The paper sheet transport path T1 includes the lower supply mechanism 12, a reversing roller 20, a feeding roller 21, a upstream transport roller pair 30, a first transport roller pair 31, and a second transport roller pair 32, which constitute the paper sheet transport device 9.

Reference numeral P1 represents a paper sheet bundle set in the paper sheet tray 6. The lower supply mechanism 12 feeds the paper sheets one by one from the paper sheet bundle P1 set in the paper sheet tray 6. The lower supply mechanism 12 includes a pick-up roller 16, a lower feed roller 17, and a lower separation roller 18.

The paper sheets in the paper sheet bundle P1 accommodated in the paper sheet tray 6 are picked up from the paper sheet tray 6 by the pick-up roller 16, and are fed toward the reversing roller 20 while being nipped between the lower feed roller 17 and the lower separation roller 18. The reversing roller 20 is a roller that transports a recording paper while reversing the recording paper on the outer peripheral surface. The rollers denoted by reference numerals 22 and 24 are a first reverse driven roller and a third reverse driven roller, respectively, that cooperate with the reversing roller 20 to nip the recording paper therebetween. The recording paper is reversed by the reversing roller 20, and is fed toward the feeding roller 21 with a surface that has been upward in the paper sheet tray 6 oriented downward.

The feeding roller 21 is disposed downstream of the reversing roller 20. Further, the reversing roller 20 and the feeding roller 21 are driven by a driving source, which is not shown. The roller denoted by reference numeral 25 is a first feeding driven roller that cooperates with the feeding roller 21 to nip the recording paper therebetween. The recording paper is fed to the upstream transport roller pair 30 located downstream of the feeding roller 21 while being nipped between the feeding roller 21 and the first feeding driven roller 25. The upstream transport roller pair 30 is composed of a driving roller 30*a* and a driven roller 30*b*.

The first transport roller pair 31 and the second transport roller pair 32 that transport a recording paper are disposed downstream of the recording head 10 in the paper sheet transport direction. The first transport roller pair 31 is composed of a first transport driving roller 31*a* and a first transport driven roller 31*b*. The second transport roller pair 32 is composed of a second transport driving roller 32*a* and a second transport driven roller 32*b*. The driving roller 30*a*, the first transport driving roller 31*a*, and the second transport driving roller 32*a* are each rotationally driven by a motor, which is not shown.

A paper sheet support member 33 that supports a recording paper is disposed at a position facing the recording head 10. While a recording paper supported by the paper sheet support member 33 passes through a recording region K, recording is performed on the recording paper by ejecting ink from the plurality of nozzles 11 of the recording head 10. After recording is performed by the recording head 10, the recording paper is discharged to the discharge tray 19 by the first transport roller pair 31 and the second transport roller pair 32.

Next, with reference to FIG. 3 as well, a paper sheet transport path T2, which is a transport path for a recording paper fed from the paper sheet setting unit 8 by the upper supply mechanism 7 will be described. The recording paper fed by the upper supply mechanism 7 is set in the paper sheet setting unit 8. A plurality of sheets of recording paper can be set in the paper sheet setting unit 8. In FIG. 3, reference numeral P2 represents a paper sheet bundle set in the paper sheet setting unit 8. It should be noted that a single sheet of recording paper can also be set in the paper sheet setting unit 8.

The paper sheet setting unit 8 is formed as a hopper that swings relative to the rotation shaft 8*a* disposed upstream in the paper sheet transport direction. As shown in FIG. 2, a paper support 34 that supports the trailing end of the paper sheet bundle P2 is disposed upstream of the paper sheet setting unit 8. The paper support 34 is configured to be housed in a housing section 35 located under the paper support 34 in FIG. 2, and to be pulled out from the housing section 35. When a paper sheet is supplied by the upper supply mechanism 7, the paper support 34 is pulled out from the housing section 35. When the upper supply mechanism 7 is not used, the paper support 34 can be housed in the housing section 35 so that the upper cover 2*a* can be closed.

Referring back to FIG. 3, an upper feed roller 13, an upper separation roller 14, and a downstream feed roller pair 15, which constitute the upper supply mechanism 7, are disposed downstream of the paper sheet setting unit 8. The paper sheet setting unit 8 swings so that the distal end thereof approaches the upper feed roller 13. The upper feed roller 13 rotates to cause an uppermost recording paper of the paper sheet bundle P2 set in the paper sheet setting unit 8 to be fed downstream. The upper separation roller 14 cooperates with the upper feed roller 13 to nip a recording paper therebetween to thereby separate a single sheet from a plurality of sheets of recording paper. The recording paper fed by the upper feed roller 13 is further fed downstream by the downstream feed roller pair 15. The downstream feed roller pair 15 is composed of a driving roller 15*a* and a driven roller 15*b* that rotates driven by the driving roller 15*a*.

The paper sheet transport path T2 joins the paper sheet transport path T1 described above at a first joining section G1, which is located upstream of a nip position between the feeding roller 21 and the first feeding driven roller 25. The recording paper transported along the paper sheet transport path T2 enters the paper sheet transport path T1 via the first joining section G1, and is then fed into the recording region K by the upstream transport roller pair 30 as with the case of the recording paper fed from the paper sheet tray 6. After recording is performed by the recording head 10, the recording paper is discharged to the discharge tray 19 by the first transport roller pair 31 and the second transport roller pair 32.

Next, the switchback path T3, which is a transport path in double-sided recording, will be described. In double-sided recording, recording is first performed onto the first surface of the recording paper, and then the upstream transport roller pair 30, the first transport roller pair 31, and the second transport roller pair 32 shown in FIG. 3 are rotated in an opposite direction from the rotation direction during the recording onto the first surface. Accordingly, the recording paper is transported in the −Y direction, which is opposite from the +Y direction in which the paper sheet is transported in recording by the recording head 10, and then enters the switchback path T3. In the switchback path T3, the recording paper is transported in the −Y direction while being nipped between the feeding roller 21 and the second feeding driven roller 26, and is then further transported in the −Y direction while being nipped between the reversing roller 20 and the second reverse driven roller 23.

The switchback path T3 joins the paper sheet transport path T1 at a second joining section G2, which is located upstream of a nip position between the reversing roller 20 and the third reverse driven roller 24. When entering the paper sheet transport path T1, the recording paper is reversed and transported being by the reversing roller 20. Accordingly, the recording paper is fed to the recording region K with the first surface, which has been a recording surface, oriented downward, and the second surface oriented upward, that is, facing the recording head 10. After recording is performed onto the second surface of the recording head 10 in the recording region K, the recording paper is discharged toward the discharge tray 19.

Next, the detection unit 40 disposed between the first transport roller pair 31 and the second transport roller pair 32 in the paper sheet transport path T1 of the printer 1 will be described. The detection unit 40 is a unit for detecting a recording paper by using detection light that intersects the paper sheet transport path T1. In the present embodiment, the detection unit 40 is an optical sensor. In the following description, the detection unit 40 disposed between the first transport roller pair 31 and the second transport roller pair 32 will be described as an example of the detection unit. However, other detection units (not shown) are further disposed at other positions in the printer 1, and the embodiments described below can be applied to these detection units.

First Embodiment

Figure 4:
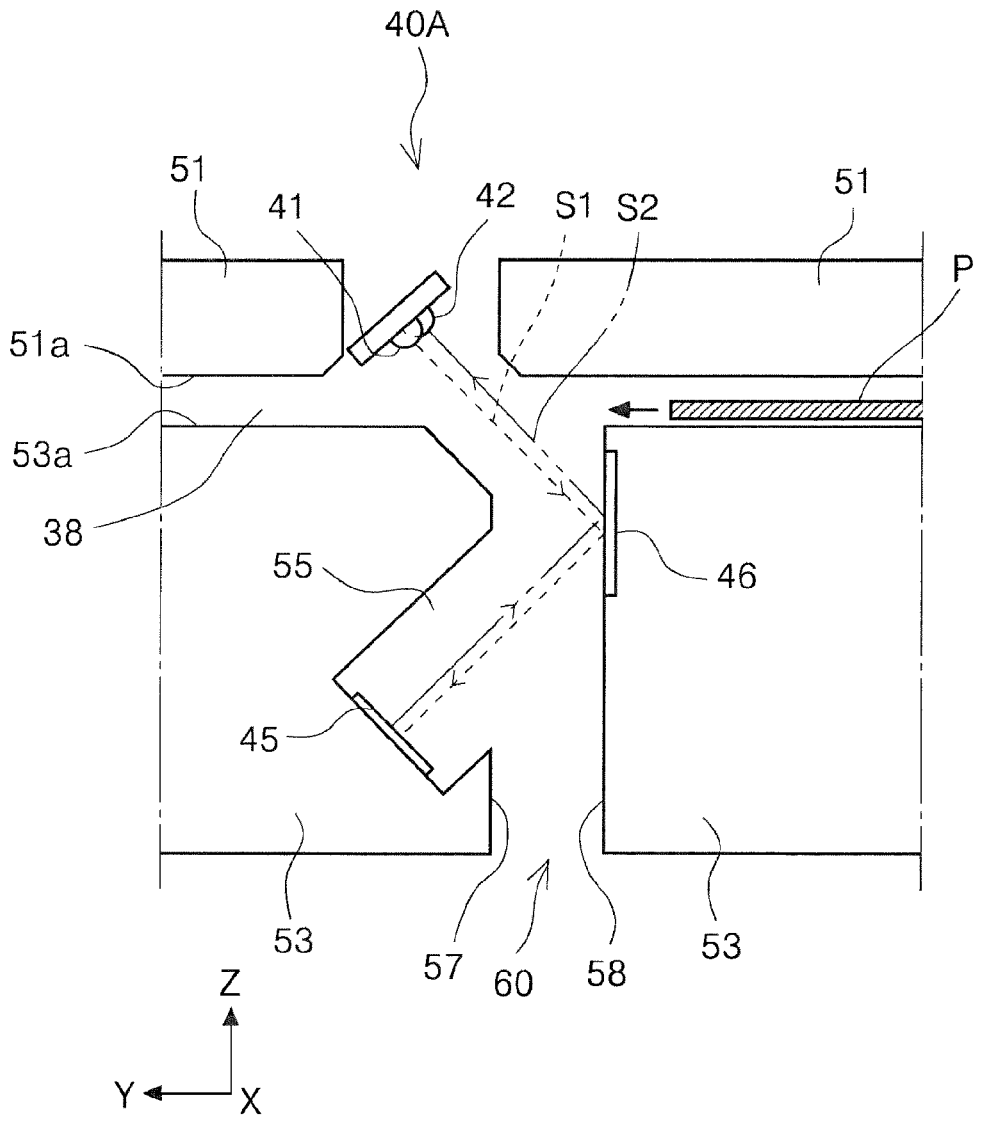
FIG. 4 is a view illustrating a first embodiment of a detection unit.

With reference to FIG. 4, a first embodiment of the detection unit 40 will be described. The detection unit of the first embodiment is denoted by reference numeral 40A. In FIG. 4, reference numeral 38 is a paper sheet transport path between the first transport roller pair 31 and the second transport roller pair 32. The paper sheet transport path 38 extends in a direction intersecting the vertical direction. In the present embodiment, the paper sheet transport path 38 extends in a substantially horizontal direction. Although the paper sheet transport path 38 extends slightly upward toward a downstream part (in FIG. 4, left direction) in a strict sense, it extends horizontally in FIG. 4 for convenience of illustration.

Reference numeral 51 denotes an upper path forming member that forms an upper portion of the paper sheet transport path 38, and reference numeral 51*a* denotes an upper path forming surface. Further, reference numeral 53 denotes a lower path forming member that forms a lower portion of the paper sheet transport path 38, and reference numeral 53*a* denotes a lower path forming surface.

The detection unit 40A is a part constituting the optical path of detection light, and includes a first optical component positioned on a first side of the paper sheet transport path 38, and a second optical component positioned on a second side with the paper sheet transport path 38 interposed therebetween. In the present embodiment, the first optical component is composed of a light emitting element 41 that emits detection light and a light receiving element 42 that receives detection light, and the second optical component is composed of a first reflecting plate 45. A surface of the first reflecting plate 45 is a reflecting surface that reflects detection light.

In the lower path forming member 53, a penetrating section 60 extending in a direction intersecting the lower path forming surface 53*a* is formed. In FIG. 4, a wall face of the penetrating section 60 at a downstream position is denoted by reference numeral 57, and a wall face of the penetrating section 60 at an upstream position, that is, a surface facing the wall face 57 is denoted by reference numeral 58. Hereinafter, the wall face denoted by reference numeral 58 is referred to as a facing surface.

The wall face 57 has a recess 55 such that a first reflecting plate 45 is accommodated in the recess 55. A second reflecting plate 46 is provided on the facing surface 58 that faces the wall face 57. A surface of the second reflecting plate 46 is a reflecting surface that reflects detection light. Detection light emitted from the light emitting element 41 is reflected by the second reflecting plate 46, and travels toward the first reflecting plate 45. The dotted line denoted by reference numeral S1 indicates an optical path of the detection light traveling from the light emitting element 41 toward the first reflecting plate 45, that is, a forward path of the detection light. The detection light that has reached the first reflecting plate 45 is reflected by the first reflecting plate 45 and then reflected by the second reflecting plate 46, and travels toward the light receiving element 42. The double dotted and dashed line denoted by reference numeral S2 indicates an optical path of the detection light traveling from the first reflecting plate 45 toward the light receiving element 42, that is, a backward path of the detection light.

According to the present embodiment, since the first reflecting plate 45 constituting the second optical component is accommodated in the recess 55, the first reflecting plate 45 is hidden from the paper sheet transport path 38 to thereby reduce attachment of foreign matters to the first reflecting plate 45. The foreign matters include paper dust, ink mist, and dust. Further, since the second reflecting plate 46 is disposed on the facing surface 58 that intersects the paper sheet transport path 38, foreign matters are not likely to be attached to the second reflecting plate 46. In the present embodiment, the facing surface 58 is substantially perpendicular to the lower path forming surface 53*a*.

According to the present embodiment, the paper sheet transport path 38 extends in a direction intersecting the vertical direction, and the first reflecting plate 45 constituting the second optical component is positioned under the paper sheet transport path 38. With this arrangement, attachment of foreign matters, which often fall and adhere to the first reflecting plate 45, can be reduced since the first reflecting plate 45 is accommodated in the recess 55. In addition, since the light emitting element 41 and the light receiving element 42 constituting the first optical component are positioned above the paper sheet transport path 38, almost no foreign matter is attached thereto. Even if foreign matter is attached, the amount is significantly small compared with that of the first reflecting plate 45.

Further, in the present embodiment, since the wall face 57 extends from the recess 55 in a direction intersecting the paper sheet transport path 38, that is, downward, and more specifically, the wall face 57 is formed by the penetrating section 60, it is possible to prevent foreign matters from accumulating at the lower end of the wall face 57 and entering the recess 55. In addition, the penetrating section 60 may also be replaced with a bottomed recess. However, in that case, the bottom of the recess is preferably located further below the lower end of the recess 55. With this configuration, it is possible to prevent foreign matters from being attached to the bottom of the recess and accumulating to a position of the first reflecting plate 45 accommodated in the recess 55.

Second Embodiment

Figure 5:
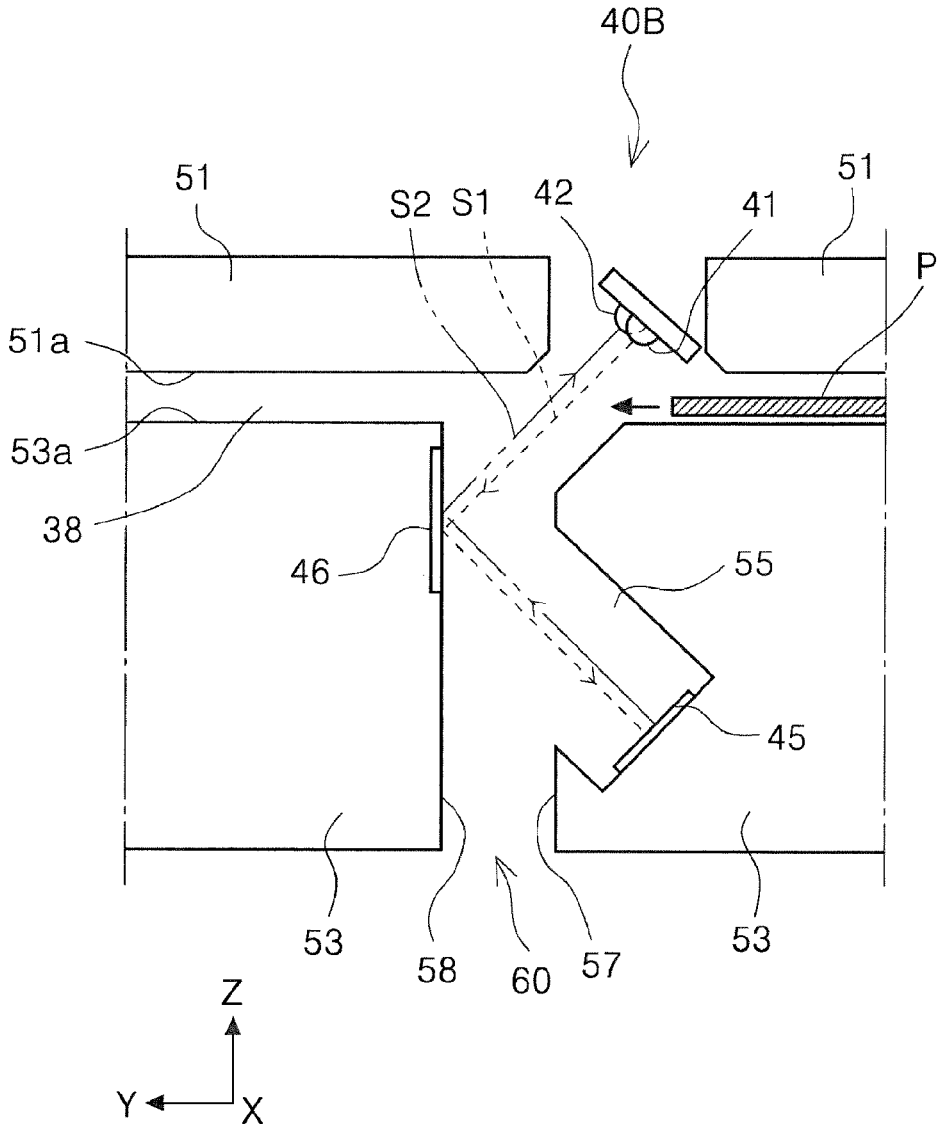
FIG. 5 is a view illustrating a second embodiment of a detection unit.

In the aforementioned first embodiment, the wall face 57 in which the recess 55 is formed is oriented upstream (−Y direction) in the paper sheet transport direction (Y axis direction). However, as shown in FIG. 5, according to a detection unit 40B of a second embodiment, the wall face 57 may also be oriented downstream (+Y direction) in the paper sheet transport direction. In addition, in the embodiments described below including the present embodiment, the same components as those previously described are denoted by the same reference numerals, and duplicated description will be omitted.

Third Embodiment

Figure 6:
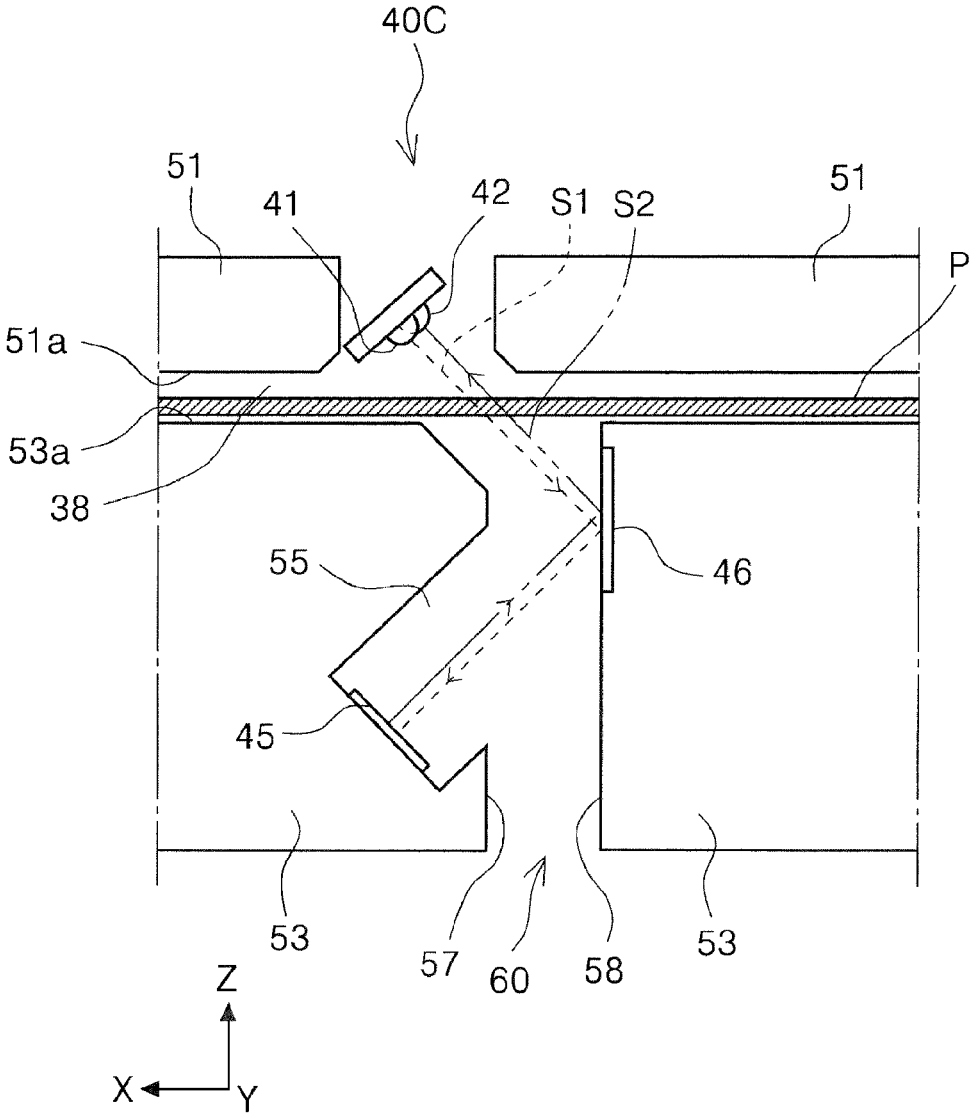
FIG. 6 is a view illustrating a third embodiment of a detection unit.

As shown in FIG. 6, according to a detection unit 40C, the wall face 57 may also be a surface extending in the paper sheet transport direction (Y axis direction). In FIG. 6, a horizontal direction is the paper sheet width direction, and a direction extending from the front surface to the rear surface or from the rear surface to the front surface of the drawing is the paper sheet transport direction. The wall face 57 in the present embodiment is a surface perpendicular to the X axis direction and parallel to the Y-Z plane. In addition, in all the embodiments except for the present embodiment, the wall face 57 is a surface perpendicular to the Y axis direction and parallel to the X-Z plane.

Fourth Embodiment

Figure 7:
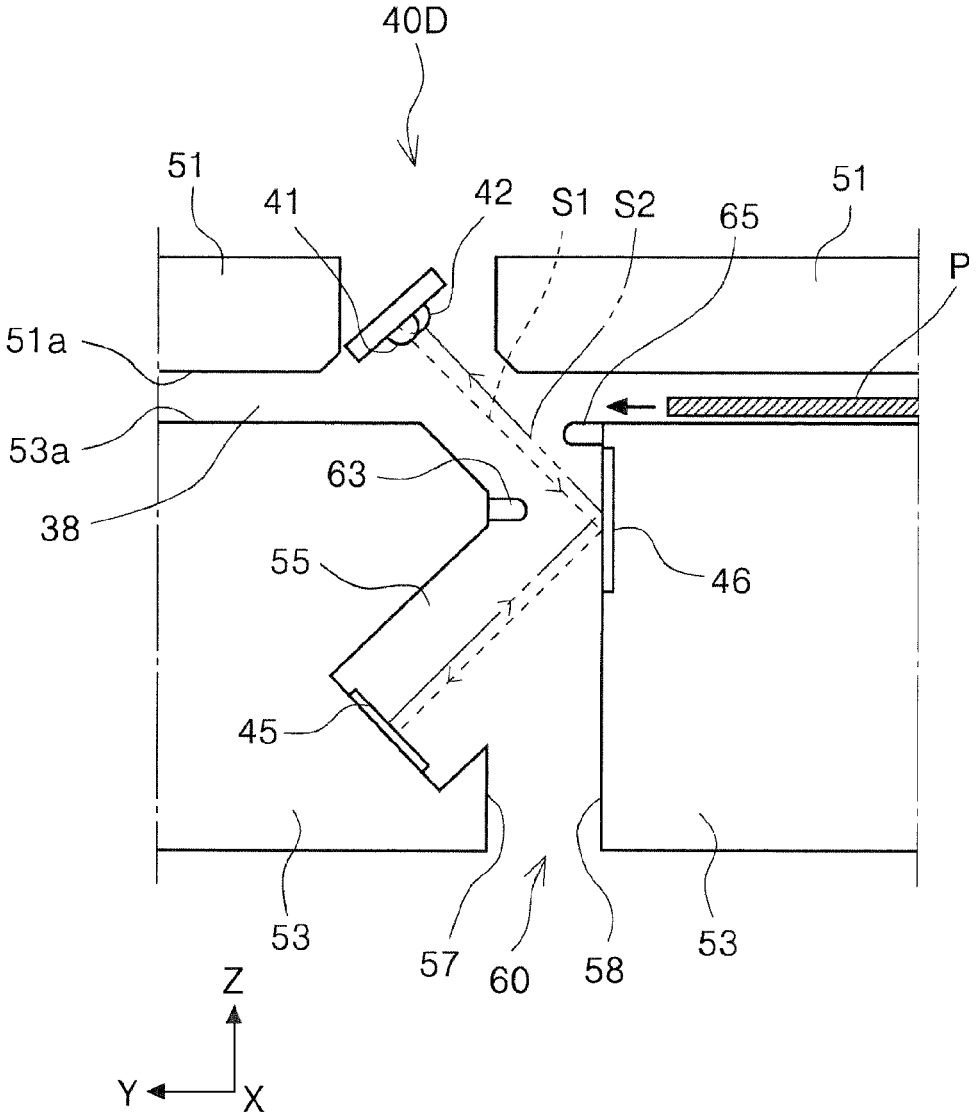
FIG. 7 is a view illustrating a fourth embodiment of a detection unit.

With reference to FIG. 7, a fourth embodiment of the detection unit 40 will be described. The detection unit of the fourth embodiment is denoted by reference numeral 40D. In the present embodiment, a protrusion 63 protruding from the wall face 57 is provided between the recess 55 and the paper sheet transport path 38. This protrusion 63 can reduce the amount of foreign matters flowing from the paper sheet transport path 38 toward the first reflecting plate 45. Similarly, a flange 65 protruding from the facing surface 58 is provided between the second reflecting plate 46 and the paper sheet transport path 38. This flange 65 can reduce the amount of foreign matters flowing from the paper sheet transport path 38 toward the second reflecting plate 46. In addition, only one of the protrusion 63 and the flange 65 may be provided.

Fifth Embodiment

Figure 8:
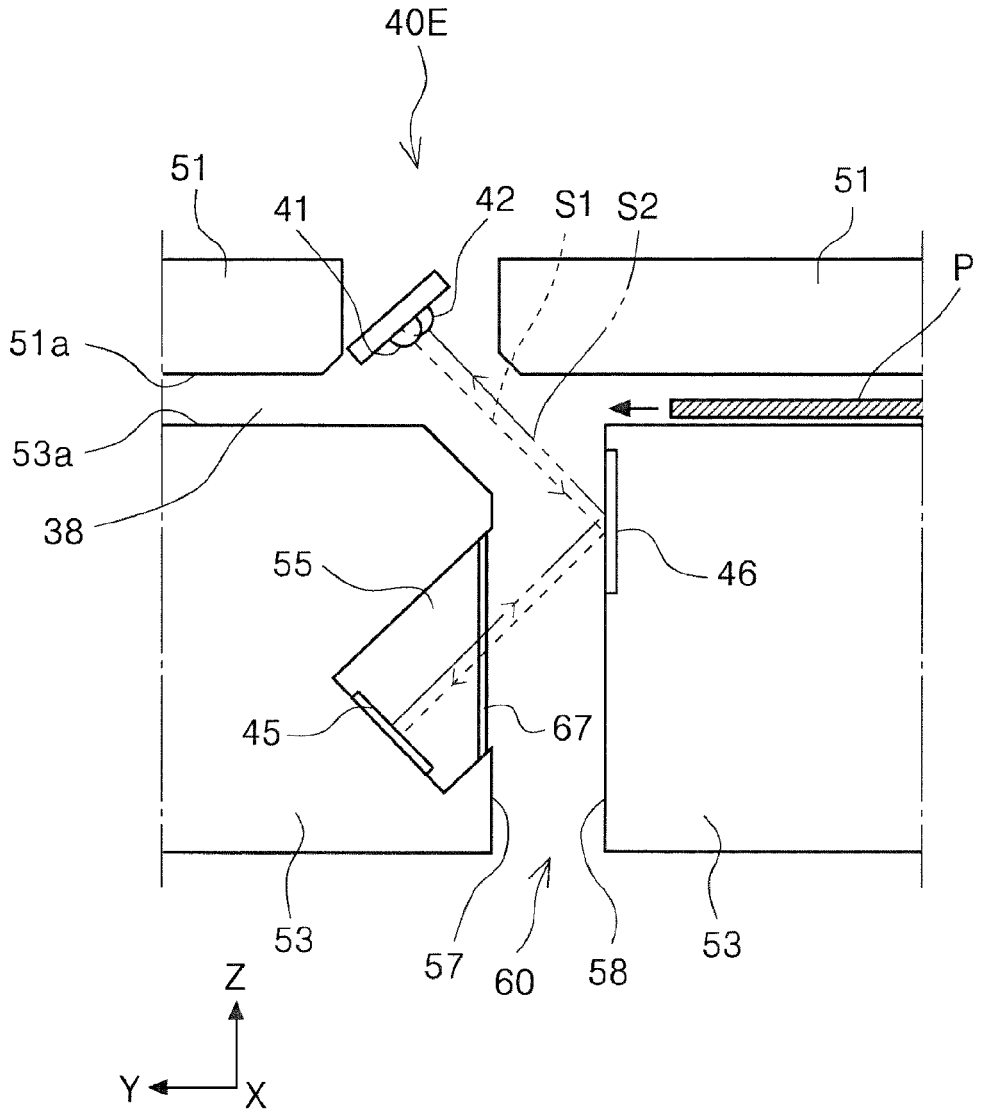
FIG. 8 is a view illustrating a fifth embodiment of a detection unit.

With reference to FIG. 8, a fifth embodiment of the detection unit 40 will be described. The detection unit of the fifth embodiment is denoted by reference numeral 40E. In the present embodiment, the recess 55 is covered with a transparent member 67 that transmits detection light. Since the recess 55 is covered with the transparent member 67, entry of foreign matters into the recess 55 can be effectively reduced.

Sixth Embodiment

Figure 9:
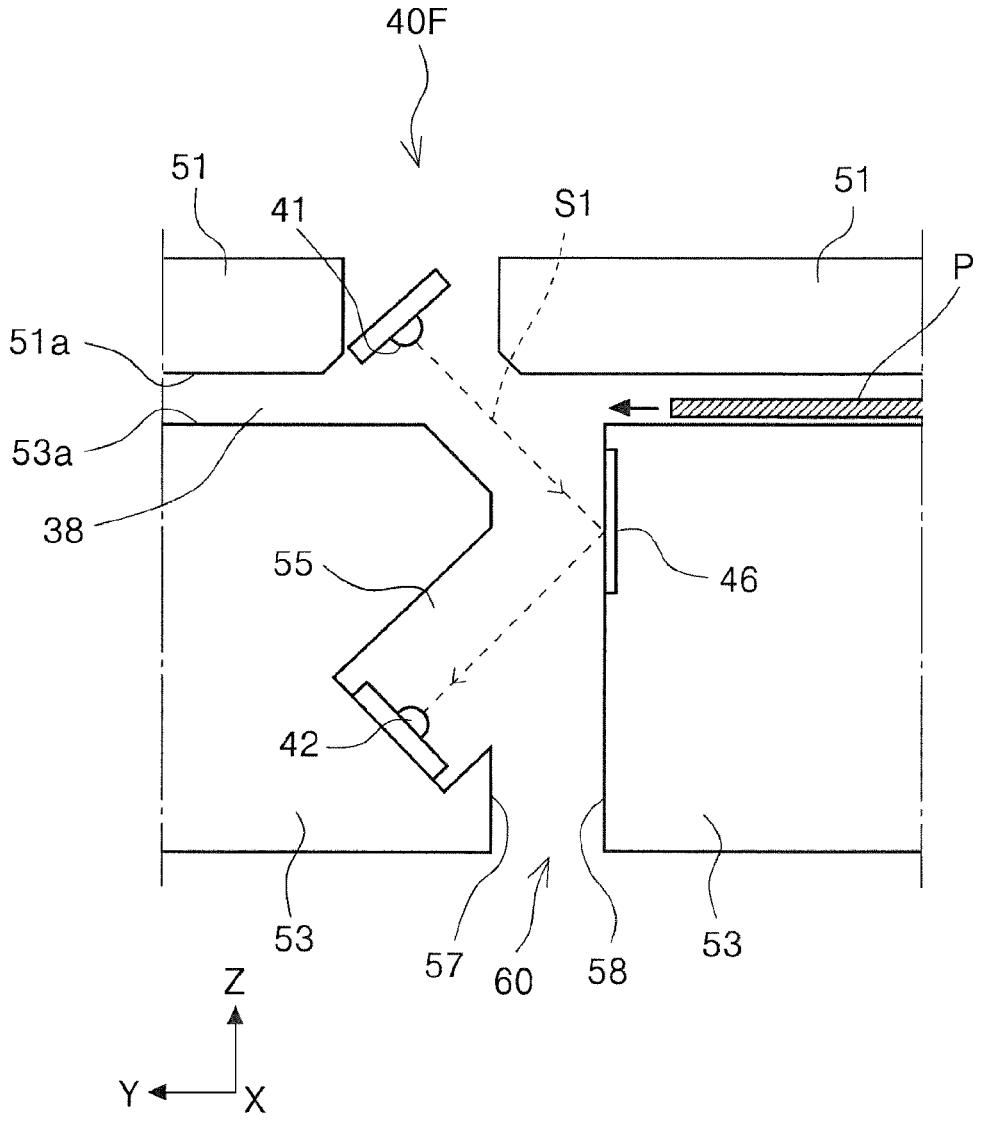
FIG. 9 is a view illustrating a sixth embodiment of a detection unit.

With reference to FIG. 9, a sixth embodiment of the detection unit 40 will be described. The detection unit of the sixth embodiment is denoted by reference numeral 40F. In the present embodiment, the first optical component is composed of the light emitting element 41, and the second optical component is composed of the light receiving element 42. That is, the light receiving element 42 is accommodated in the recess 55. With this configuration, it is possible to reduce attachment of foreign matters to the light receiving element 42. Furthermore, since the optical path length of the detection light is shorter than that in the first to fifth embodiments, detection accuracy is improved.

Seventh Embodiment

Figure 10:
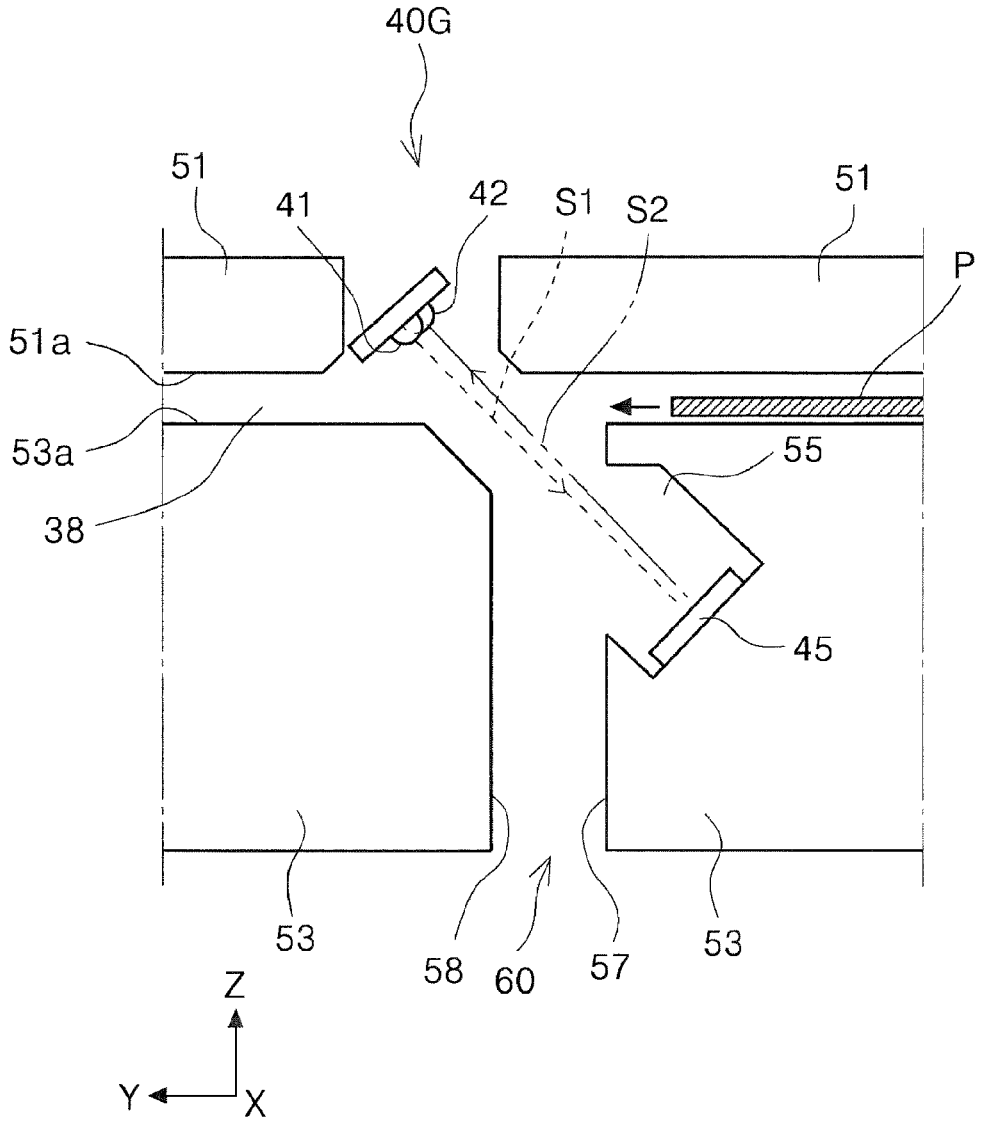
FIG. 10 is a view illustrating a seventh embodiment of a detection unit.

With reference to FIG. 10, a seventh embodiment of the detection unit 40 will be described. The detection unit of the seventh embodiment is denoted by reference numeral 40G. In the present embodiment, the first optical component is composed of the light emitting element 41 and the light receiving element 42, and the second optical component is composed of the first reflecting plate 45 such that the first optical component and the second optical component are positioned to face each other. In the present embodiment as well, it is possible to reduce attachment of foreign matters to the first reflecting plate 45 since the first reflecting plate 45 constituting the second optical component is disposed in the recess 55.

Eighth Embodiment

Figure 11:
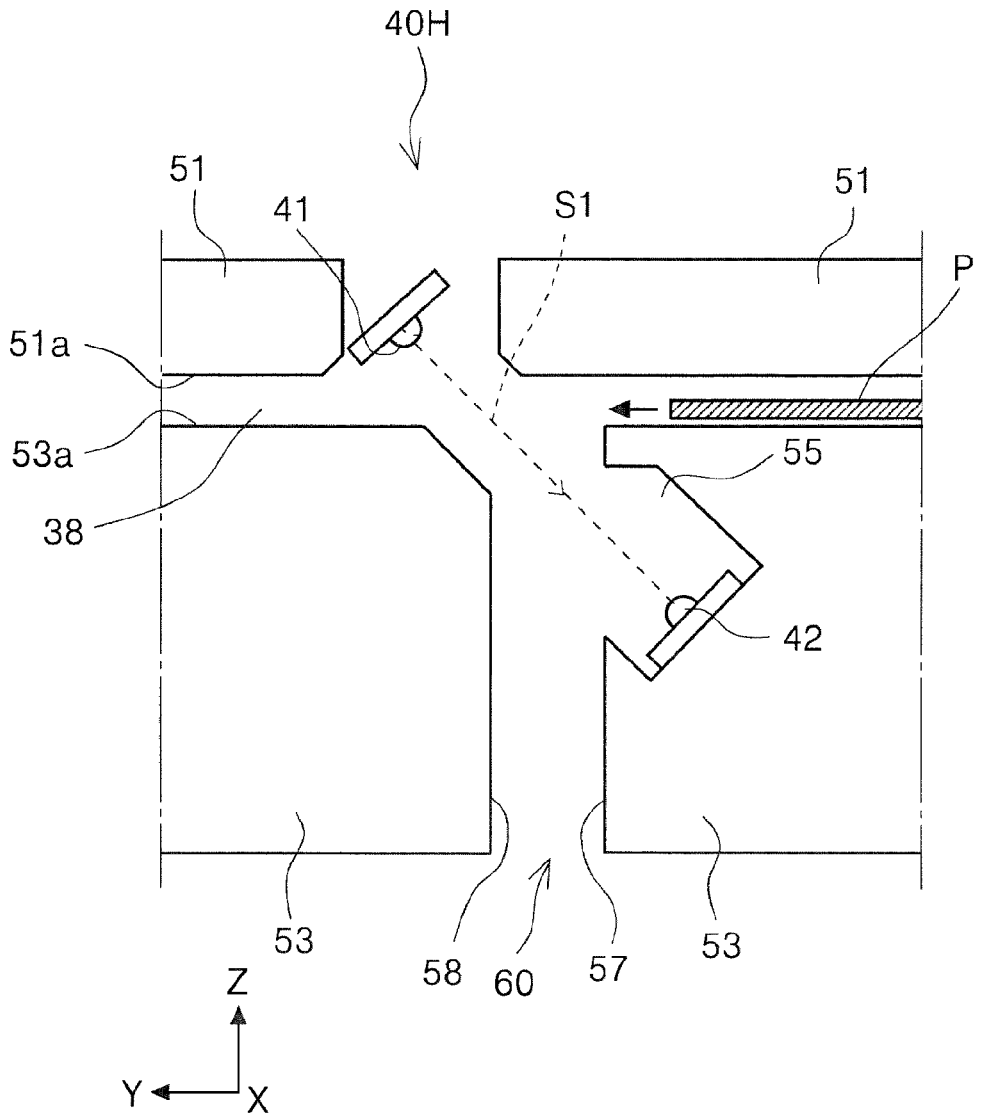
FIG. 11 is a view illustrating an eighth embodiment of a detection unit.

With reference to FIG. 11, an eighth embodiment of the detection unit 40 will be described. The detection unit of the eighth embodiment is denoted by reference numeral 40H. In the present embodiment, the first optical component is composed of the light emitting element 41, and the second optical component is composed of the light receiving element 42 such that the first optical component and the second optical component are positioned to face each other. In the present embodiment as well, it is possible to reduce attachment of foreign matters to the light receiving element 42 since the light receiving element 42 constituting the second optical component is disposed in the recess 55. Furthermore, since the optical path length of the detection light is shorter than that in the seventh embodiment, detection accuracy is improved.

The present disclosure is not limited to the aforementioned embodiments. Various modifications can be made within the scope of the invention defined by the appended claims, and such modifications should be included in the scope of the invention. For example, the protrusion 63 and the flange 65 described in connection with FIG. 7 and the transparent member 67 described in connection with FIG. 8 can be applied to the embodiments shown in FIGS. 5, 6, 9, 10, and 11. Further, in the embodiments shown in FIGS. 9 and 11, the first optical component is composed of the light emitting element 41, and the second optical component is composed of the light receiving element 42. However, instead of this configuration, the first optical component may be composed of the light receiving element 42, and the second optical component may be composed of the light emitting element 41, that is, the light emitting element 41 may be accommodated in the recess 55. Similarly, in the embodiments shown in FIGS. 4 to 8 and 10, the first optical component is composed of the light emitting element 41 and the light receiving element 42, and the second optical component is composed of the first reflecting plate 45. However, instead of this configuration, the first optical component may be composed of the first reflecting plate 45, and the second optical component may be composed of the light emitting element 41 and the light receiving element 42, that is, the light emitting element 41 and the light receiving element 42 may be accommodated in the recess 55. In addition, in the aforementioned embodiments, one of the first optical component and the second optical component, that is, only the second optical component is accommodated in the recess. However, a recess may also be formed for each of the second optical component and the first optical component, and both may be accommodated in the respective recesses.

What is claimed is:

1. A medium transport device comprising:

a medium transport path that transports a medium; and a medium detection unit that detects a medium by using detection light intersecting the medium transport path, wherein the medium detection unit is a part constituting an optical path of the detection light, and includes a first optical component positioned on a first side of the medium transport path, and a second optical component positioned on a second side with the medium transport path interposed therebetween, and one or both of the first optical component and the second optical component are accommodated in a recess formed in a wall face that extends in a vertical direction intersecting a path surface of the medium transport path.

2. The medium transport device according to claim 1, wherein the medium transport path extends in a direction intersecting a vertical direction, and the second optical component is positioned under the medium transport path and accommodated in the recess.

3. The medium transport device according to claim 2, further comprising a protrusion that protrudes from the wall face between the recess and the medium transport path.

4. The medium transport device according to claim 2, wherein the wall face extends downward from the recess.

* * * * *